US011136181B2

(12) United States Patent
Matteucci et al.

(10) Patent No.: US 11,136,181 B2
(45) Date of Patent: Oct. 5, 2021

(54) POPCORN CONTAINER

(71) Applicants: Rose Elizabeth Matteucci, Castro Valley, CA (US); Carlo Matteucci, Castro Valley, CA (US)

(72) Inventors: Rose Elizabeth Matteucci, Castro Valley, CA (US); Carlo Matteucci, Castro Valley, CA (US)

( * ) Notice: Subject to any disclaimer, the term of this patent is extended or adjusted under 35 U.S.C. 154(b) by 0 days.

(21) Appl. No.: 16/121,611

(22) Filed: Sep. 4, 2018

(65) Prior Publication Data

US 2019/0071244 A1 Mar. 7, 2019

Related U.S. Application Data

(60) Provisional application No. 62/553,707, filed on Sep. 1, 2017.

(51) Int. Cl.

| | |
|---|---|
| ***B65D 25/22*** | (2006.01) |
| ***B65D 25/28*** | (2006.01) |
| ***B65D 85/60*** | (2006.01) |
| ***B65D 3/28*** | (2006.01) |

(52) U.S. Cl.

CPC ..... *B65D 85/60* (2013.01); *B65D 3/28* (2013.01); *B65D 25/22* (2013.01); *B65D 25/2847* (2013.01)

(58) Field of Classification Search

None

See application file for complete search history.

(56) References Cited

U.S. PATENT DOCUMENTS

| | | | | |
|---|---|---|---|---|
| 6,116,503 | A * | 9/2000 | Varano | B65D 3/06 229/402 |
| 6,152,362 | A * | 11/2000 | Rosenfeld | B65D 25/20 220/23.83 |
| 6,651,947 | B1 * | 11/2003 | Price | A47C 1/12 220/737 |
| 2004/0228546 | A1 * | 11/2004 | Smidt | B65D 33/14 383/14 |
| 2013/0026336 | A1 * | 1/2013 | Beckey | A47G 23/0216 248/692 |
| 2014/0217096 | A1 * | 8/2014 | Simpson | B65D 43/0212 220/212.5 |

OTHER PUBLICATIONS

Name: imprintitems.com Product: Item #128B Popcorn Pail / Bucket w/ Handle, Lid—128 oz Website: https://www.imprintitems.com/product/popcorn-pail-bucket-w-handle-lid-128-oz Publication: (n.d.).

Name: bright-ideas.org Product: PaperSplash Megaphone Website: https://www.bright-ideas.org/ws/ws.dll/PrDtl?UID=10482&SPC=aaunh-mynpn&Detail=Publication: (n.d.).

* cited by examiner

*Primary Examiner* — Viren A Thakur
*Assistant Examiner* — Thanh H Nguyen
(74) *Attorney, Agent, or Firm* — Lamon Patent Services; Cynthia S. Lamon

(57) ABSTRACT

A container is provided including a handle assembly. The handle assembly comprising a reinforcement strip adhered to an outside surface of the container. At least two handles are attached to opposing sides of the strip and are enabled to be grasped by a user. A base tab may also extend downwards from the strip. Wherein the base tab is enabled to be lifted away from the surface and inserted inside a cup or drink holder while supporting the container outside of the cup or drink holder.

8 Claims, 4 Drawing Sheets

POPCORN CONTAINER

CROSS-REFERENCE TO RELATED APPLICATIONS

The present application claims priority to a provisional patent application, 62/553,707, filed Sep. 1, 2017, and all disclosure of the parent application is incorporated herein at least by reference.

BACKGROUND OF THE INVENTION

1. Field of the Invention

The present invention relates generally to a snack container, and in particular to a system and method for handling a large size snack container more securely, as well as affixing the snack container to a cup or drink holder having a smaller diameter and volume than the snack container.

2. Description of Related Art

Snack containers, for example large popcorn-type buckets are commonly used at movie theaters, as well other entertainment, stadium and sports venues where attendees often enjoy a concession snack. In home residential movie and media rooms are also on the rise having specialized furniture with drink holders commonly on an arm rest. However, these snack containers have limited ability for the popcorn or snack food consumer to grip them in a secure or stable fashion, especially when the popcorn receptacles are round, tub like and larger in size. Furthermore, the popcorn or food purchaser is unable to properly set or securely place their container of popcorn in a convenient, accessible, or designated position while seated or while leaving the container unattended.

Consumers who wish to enjoy and purchase popcorn or a similar snack food are forced to currently carry around a typical popcorn or snack food container without handles, grips or designated implements to properly handle and securely hold or grip said container or receptacle. Consumers are forced to straddle, cradle, pinch, balance or insecurely attempt to hold the container with both hands while trying not to spill or dump its contents. Snack containers, like popcorn buckets are therefore inconvenient, uncomfortable and cumbersome to attempt to hold or carry.

Furthermore, as is common with popcorn and snack containers in the current art, there is no easily convenient or designated means or method to safely and securely affix or place the container in an accessible and appropriate position near or adjacent to the consumer while they are seated or wish to leave their popcorn or snack receptacle unattended or conveniently situated in a securely fastened or attached, clean, safe, affixed and unobstructed position. Consumers are often left with the task of straddling their popcorn or snack container on their lap or cradling the container during and/or throughout the movie or entertainment event. Or the consumer might often attempt to balance and/or hand off the container to parties in their group for the purposes of sharing. The snack often ending up on the floor or spilled on the consumers lap or seat.

Furthermore, since no current popcorn or snack buckets, containers, tubs, bags or any such containers currently have appropriate handles, specific grips or specific implements to properly and ergonomically hold, carry, and transport the container, the result is a cumbersome and often futile attempt to carefully balance the container or awkwardly attempt to hold it in an unsecure, unnatural, uncomfortable or unconfident way, whereupon the contents could unfortunately and inadvertently be spilled or dumped out.

What is needed is a system and method by which a consumer can easily and securely hold, stabilize and transport their popcorn or snacks freely in a container designated with specific handling and/or gripping implements. The inventors of the present invention, therefore, provide a securely attached, neatly positioned to the seat, snack container that is hands free and can be accessibly enjoyed or shared without being obstructive or cumbersome to the consumer.

BRIEF SUMMARY OF THE INVENTION

The present invention, in one embodiment provides a container which may include a handle assembly. The handle assembly may include a reinforcement strip adhered to an outside surface of the container, two handles attached to opposing sides of the strip enabled to be grasped by a user. In this embodiment a base tab may extend downwards from the strip which is enabled to be inserted in a cup or drink holder on a proximal end of an arm of a theatre chair, for example.

In one embodiment the base tab may be enabled to be lifted away from the surface of the container and insert inside a cup or drink holder while supporting the container outside of the cup or drink holder. Another embodiment provides that the container has a larger diameter than the cup or drink holder.

In this embodiment a top edge of the base tab is wider than the strip and the base tab conforms to an inside shape of the cup or drink holder enabling insertion of a cup or drink into the cup or drink holder while the container is supported on the outside of the container. An alternative embodiment may include that the container includes a dome handle connected to an upper rim of the container, enabling vertical lifting and lowering of the container from the cup or drink holder.

One embodiment provides a method for mounting a container, providing a container with an outside surface; attaching a vertically elongate reinforcement strip to the outside surface, the strip having attached handles on opposing sides, the handles positioned flush with the outside surface; pulling a base tab extending downward from the strip to a lip at a bottom edge of the container; and with the handles extending away from the outside surface, the base tab is inserted within a cup or drink holder enabling the container to be supported outside of the cup or drink holder.

DETAILED DESCRIPTION OF THE INVENTION

Figure 1:
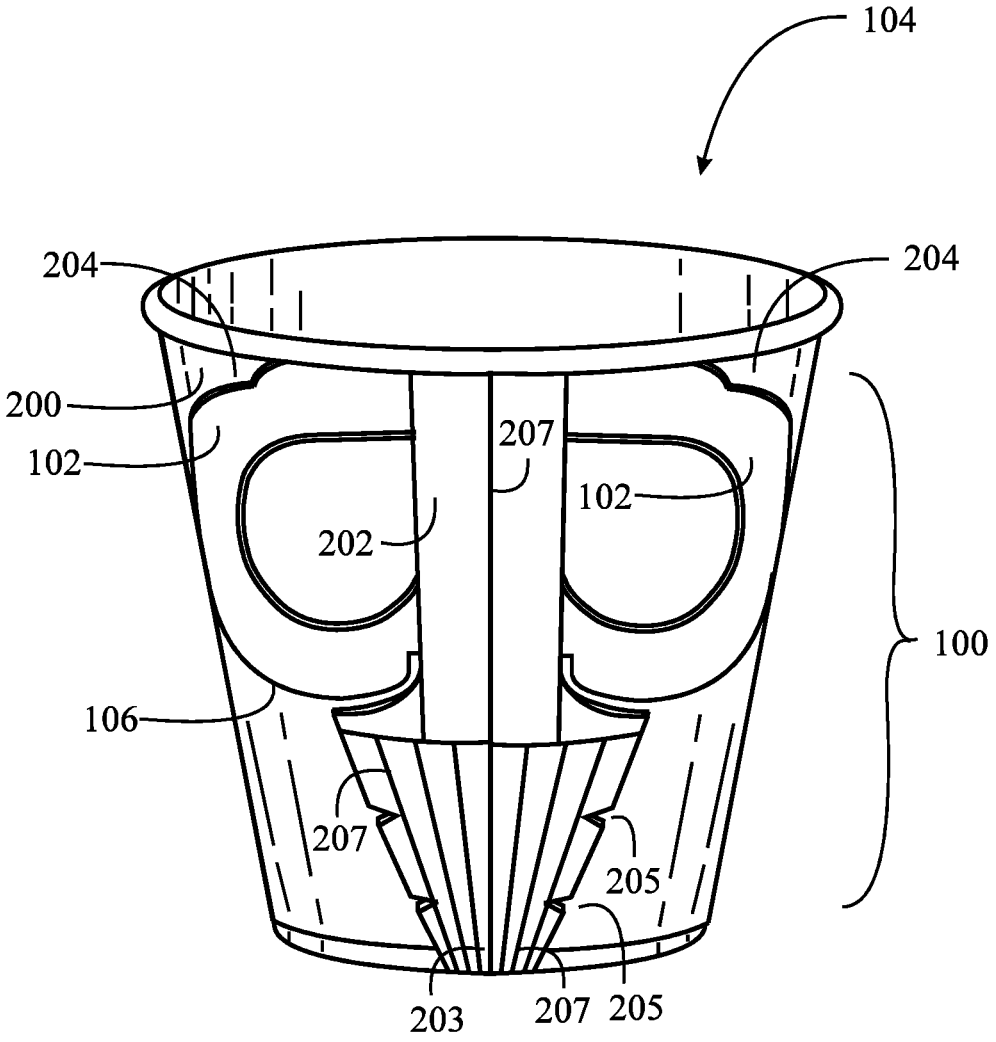
FIG. 1 is a side elevation view of the snack container showing the handle assembly prior to use.

FIG. 1 shows an embodiment of a container 104 designed to hold a large volume of popcorn or other lightweight snack item. Container 102 is any shape, size, style of cup, bowl, canister, box, carton, tub, bucket, bag or any other container wherein the contents include but are not limited to: popcorn, popcorn flavorings, butter, condiments, chips, nuts, snacks, snack foods, food, consumable loose treats, or any other concessionary food.

Handle assembly 100 and container 104 can be manufactured out of paper, cardboard, plastic, or other reinforced paper material, or biodegradable materials for example, polylactic acid (PLA) or any other biopolymer that may be commercially composted. Container 104 and handle assembly 100 may be one singular manufactured unit, or manufactured as separate, individual units and components that are adhered, manufactured, and/or combined in a later process, pre or post distribution. For example handle assembly 100 may be distributed separately with container 104 or sold separately to be attached to existing containers at an end user.

Container 104 in this embodiment may include an outer surface 200 attached to reinforcement strip 202 running the length of the container 104. Strip 202 is integrated via a centered vertical score line 207. The vertical score line 207 is formed and centered along a vertical plane of strip 202 enabling easy bending and folding of the material at the vertical score line 207. In an alternative embodiment the strips are one single strip with a score line enabling bending Strips 202 are attached sufficiently to surface 200 in order to support weight of any contents held within the container. Strips 202 may be adhered in any manner including suitable adhesive, affixing, stapling, merging, gluing, or by any means of attachment or may be integrally molded to the surface 200. Strip 202 may include a handle assembly including two opposing handles 102 fashioned as semicircles, in this embodiment, where each of two ends of the semicircles attach to opposing sides of strip 202. handles may be any shape capable of accepting parts of a user's hand. Strip 202 extends the length of container 102 supporting the handles 102 at an upper area as well as base tab 203 at a lower area of strip 202 near a bottom of container 104, the base tab extending to a bottom lip of the container. Strip 202 are of a width enabled to support the handles 102 and base tab 203, for example between one and five centimeters.

Base tab 203 attaches to and is centered around strip 202 at an upper edge, wherein a lower edge inserts into a drink or cup holder having a diameter and depth that is considerably less than a diameter and depth of the container 104. The upper edge of base tab 203 may be wider than strip 202 and may be as much as twice as wide as the strip 202. Base tab 203 includes a plurality of vertical score lines 207 enabling the base tab to conform to an inner curvature of a drink or cup holder.

In one embodiment a drink or cup holder may not be solid and be manufactured as bottomless with supporting bands formed to contain a cold cup or other drink receptacle. In this embodiment, a plurality of niches 205 may be strategically placed on opposing sides of the base tab 203 in order to engage a top edge of the bands when the base tab 203 is inserted in order to support the base tab within the drink or cup holder. niches 203 are positioned on opposing sides of base tab 203 at locations enabling adjustment of a height of container 104 in relation to the drink or cup holder.

Figure 2:
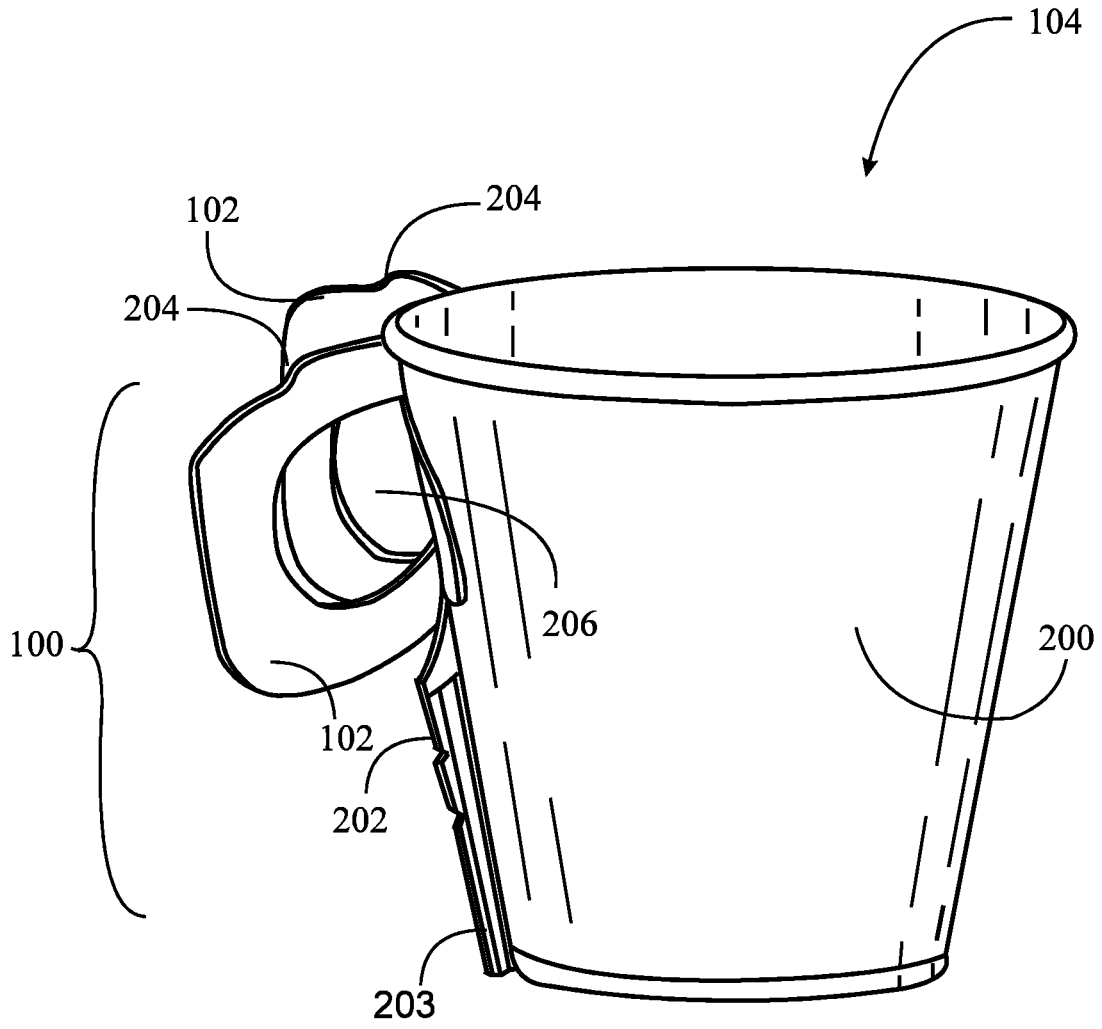
FIG. 2 is a perspective view of the container with handles of the handle assembly extended for use.

FIG. 2 depicts a side view of an embodiment of the invention showing the handles 102 folded away from the surface 200 enabling gripping by a user. Handles 102 may each have a thumb ridge 204 formed as a slight ridge extending upward from a top edge of the handles enabling a user's thumb to rest and provide leverage and stability while holding the container.

Handles 102 may be adhered to the surface 200 of container 104 in a manner enabling them to lay flat as a single planar material within a cutout recess 106 enabled to hold the handles in a manner that they lay flush with the surface 200. Recess 106, in this embodiment, includes a profile that matches an outline formed by the handles 102 on a surface 200 when the handles lay flat. In one embodiment, when the handles are manipulated away from surface 200 an interior portion of the planar material remains adhered to the surface 200 forming openings 206 and handles 102 enabling a user's hand to grasp the handles.

Figure 3:
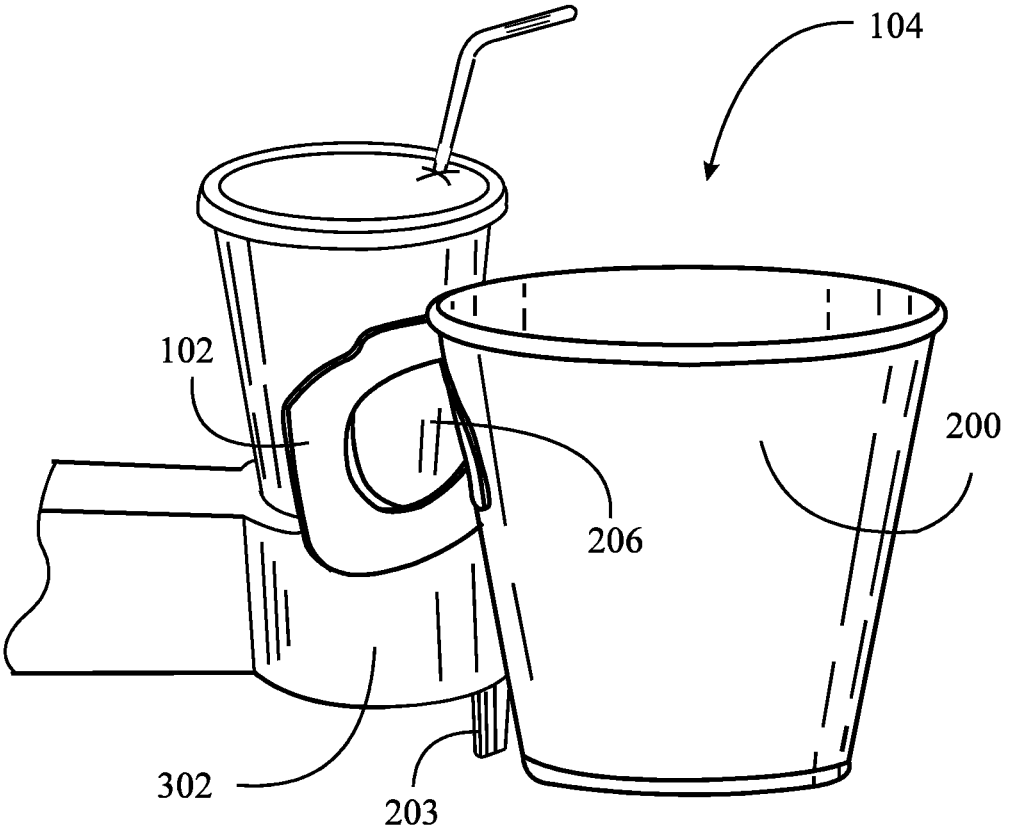
FIG. 3 is a perspective view of the container of FIG. 1 and FIG. 2 attached to a drink holder.

FIG. 3 shows an embodiment wherein container 104 is in position on a cup or drink holder 302. Cup or drink holder 302 is commonly known as positioned on a proximal end of an armrest of a chair in a movie theater, for example. Cup or drink holder may be circular, semi-circular or any other shape capable of holding a cup or drink. In this embodiment cup or drink holder 302 may include a diameter and depth that is considerable less than a depth and diameter of container 104. FIG. 3 shows a cold cup positioned inside and being held within the cup or drink holder 302.

This embodiment shows strip 202 as well as base tab 203 inserted in cup holder 302 thereby supporting container 104 on an outside yet adjacent to cup or drink holder 302. In this embodiment one each of handles 102 are positioned on either side of the cold cup. Alternatively the handles 102 may be positioned both on one side or remain in a flattened state against surface 200 as shown in FIG. 1. Within cup holder 302 base tab 203 may be detached from surface 200, inserted into cup or drink holder 302 and conformed to an inner concave surface via the material easily conforming to the inner surface via score lines 207. One with skill in the art understands that the handle assembly 100 with base tab 203 inserted and formed along an inside concave surface of the cup or drink holder 302 would adequately support container 104 even without the cold cup in place. Additionally the ability of base tab 203 to conform to the inside surface of the cup or drink holder also allows the base tab to conform to the cold cup when inserted, thereby providing additional support.

Tension between base tab 203 and surface 200 serve to provide stability and maintain the weight of the snack items within the container. In this embodiment, one cup or drink holder at a proximal end of an armrest could support a drink having a diameter that fits within the cup or drink holder as swell as a container of popcorn having a diameter larger than the cup or drink holder with no support from the user.

Figure 4:
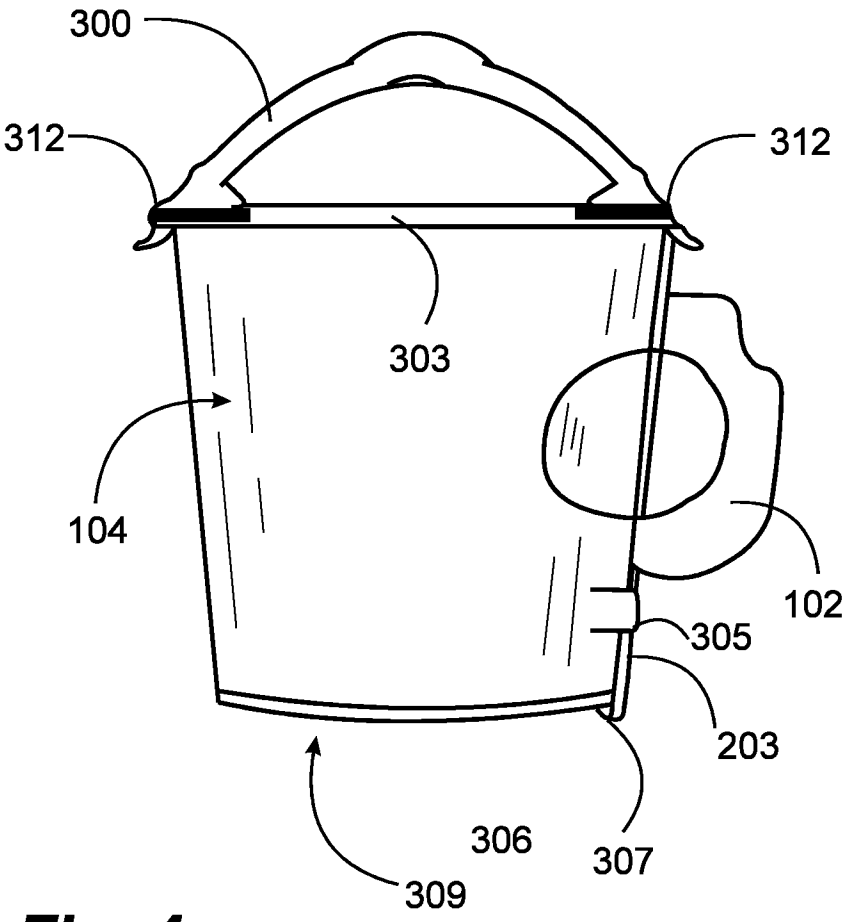
FIG. 4 is a perspective view of a dome handle of the container.
Figure 4:
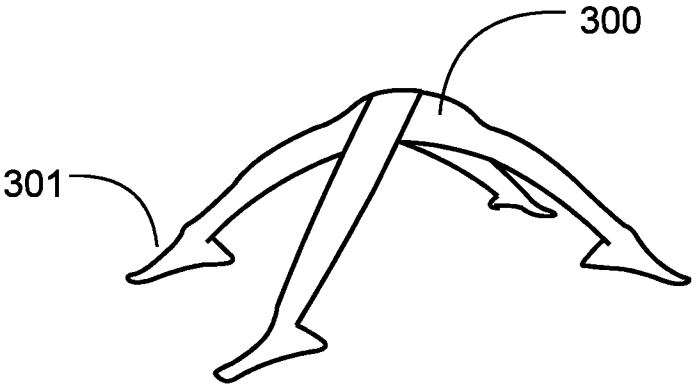

FIG. 4 shows an additional embodiment providing a support strap 305 that overlaps the strip 202 at a point where the base tab 203 engages the strip 202 in order to provide more support. One with skill in the art understands that the strips, base tab and manner of adhering the strip 202 to the surface are of sufficient strength to support container 104 with snacks contained within, while inserted on an edge of the cup or drink holder 302. Additionally, a bottom circumference of container 104 may have a lip 306 formed by a bottom surface 309 (not shown) recessed within the lip 306 of the container 104. Base tab 203 could be formed with a hook or tab 307 along the bottom edge enabling the hook or tab 307 to engage the lip 306 after insertion in the cup or drink holder with base tab 203 extending out a bottom opening of the cup or drink holder 302, thereby providing more support.

FIG. 4 is another embodiment showing a dome handle 300 providing a third handle for the container 104 that attaches to an upper rim 303 of container 104 via four engagement slots 312. Dome handle 300 may be manufactured of the same material described in reference to the container 104 and handle assembly 100. In this embodiment dome handle 300 incorporates four legs that meet at intersection 308, each of the legs extending out and connecting to slots 312 via a foot 301 at a proximal end of each leg 304. In this manner a user may lift the container out of the cup or drink container 302 with one hand without placing fingers within the container 104 and possibly contaminating contents with the container. In one embodiment dome handle 300 is comprised of two elongate members that are crossed and attached together at a center point of each elongate member. A foot 301 may be formed at opposing ends of each elongate member for engaging the slots 312. Each foot may be formed so a portion of the foot serves as a catch in the slot to retain the foot within the slot.

It will be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the components may be implemented.

The invention claimed is:

1. A container having an open top end and a closed bottom end, comprising;

a handle assembly comprising;

a reinforcement strip adhered to an outside surface of the container;

two handles attached to opposing sides of the strip enabled to be grasped by a user; and a base tab, separate from the strip, extending downwards below the strip to the closed bottom end, the base tab enabled to be lifted away from the outside surface and inserted inside a cup or drink holder;

wherein the base tab includes a top edge having a width at most twice a width of the reinforcement strip and score lines running a length of the base tab enabling the base tab to conform along an inner surface of the cup or drink holder while supporting the container outside of the cup or drink holder.

2. The container of claim 1, wherein the container has a larger diameter than the cup or drink holder.

3. The container of claim 2 wherein the base tab conforms to an inside curvature of the cup or drink holder enabling insertion of a cup or drink into the cup or drink holder while the container is supported on the outside of the cup or drink holder.

4. The container of claim 1, wherein the container includes a dome handle connected to an upper rim of the container, enabling vertical lifting and lowering of the container from the cup or drink holder.

5. A method for mounting a container, comprising:

(a) providing a container with an outside surface having an open top end and a closed bottom end;

(b) attaching a vertically elongate reinforcement strip to the outside surface, the strip having attached handles on opposing sides, the handles positioned flush with the outside surface;

(c) pulling a base tab, separate from the strip, extending downward below the strip to the bottom end of the container, the base tab including score lines running a length of the base tab, a top edge of the base tab having a width twice a width of the reinforcement strip; and (d) with the handles extending away from the outside surface, the base tab is inserted within a cup or drink holder, the top edge enabled to conform along an inner surface of the cup or drink holder, providing added stability for the container while being supported outside of the cup or drink holder.

6. The method of claim 5, wherein the container has a larger diameter than the cup or drink holder.

7. The method of claim 5 wherein the base tab conforms to an inside curvature of the cup or drink holder enabling insertion of a cup or drink into the cup or drink holder while the container is supported on the outside of the cup or drink holder.

8. The method of claim 5, wherein the container includes a dome handle connected to an upper rim of the container, enabling vertical lifting and lowering of the container from the cup or drink holder.

* * * * *